US010059911B2

(12) United States Patent
Jizaimaru et al.

(10) Patent No.: US 10,059,911 B2
(45) Date of Patent: Aug. 28, 2018

(54) WASHING HYDROGEN WATER PRODUCING METHOD AND PRODUCING APPARATUS

(71) Applicants: NOMURA MICRO SCIENCE CO., LTD., Atsugi-shi (JP); ACM RESEARCH (SHANGHAI), INC., Shanghai (CN)

(72) Inventors: Takayuki Jizaimaru, Atsugi-shi (JP); David H. Wang, Shanghai (CN)

(73) Assignees: NOMURA MICRO SCIENCE CO., LTD., Atsugi-shi (JP); ACM RESEARCH (SHANGHAI), INC., Shanghai (CN)

( * ) Notice: Subject to any disclaimer, the term of this patent is extended or adjusted under 35 U.S.C. 154(b) by 0 days.

(21) Appl. No.: 15/209,956

(22) Filed: Jul. 14, 2016

(65) Prior Publication Data

US 2017/0015956 A1 Jan. 19, 2017

(30) Foreign Application Priority Data

Jul. 17, 2015 (JP) ..... 2015-142747

(51) Int. Cl.
*C11D 11/00* (2006.01)
*B01F 15/00* (2006.01)
(Continued)

(52) U.S. Cl.
CPC ..... *C11D 11/0047* (2013.01); *B01F 3/04503* (2013.01); *B01F 3/088* (2013.01);
(Continued)

(58) Field of Classification Search
CPC ..... C11D 11/00
See application file for complete search history.

(56) References Cited

U.S. PATENT DOCUMENTS 5,783,790 A * 7/1998 Mitsumori ..... B08B 3/12 134/1
5,983,909 A * 11/1999 Yeol ..... B01F 3/04985 134/102.1
(Continued)

FOREIGN PATENT DOCUMENTS

CN 1228197 9/1999
CN 1536623 10/2004
(Continued)

OTHER PUBLICATIONS

Englis machine translation of JP 2000, 354729.*
(Continued)

*Primary Examiner* — Nicole M Buie-Hatcher
*Assistant Examiner* — M. Reza Asdjodi
(74) *Attorney, Agent, or Firm* — Oblon, McClelland, Maier & Neustadt, L.L.P.

(57) ABSTRACT

A method of producing washing hydrogen water in an embodiment, includes: a step of storing ammonia water in a first tank; a step of transferring the ammonia water from the first tank to a second tank; a step of diluting the transferred ammonia water with ultrapure water in the second tank; a step of mixing the diluted ammonia water into hydrogen water; and a washing step of washing an inside of the first tank by ultrapure water to remove fine particles derived from ammonia generated in the first tank.

6 Claims, 2 Drawing Sheets

(51) Int. Cl.

| | |
|---|---|
| ***B01F 5/04*** | (2006.01) |
| ***B01F 3/04*** | (2006.01) |
| ***B01F 3/08*** | (2006.01) |
| ***C11D 7/06*** | (2006.01) |

(52) U.S. Cl.

CPC ..... *B01F 3/0876* (2013.01); *B01F 5/0463* (2013.01); *B01F 15/00155* (2013.01); *C11D 7/06* (2013.01); *B01F 2215/004* (2013.01)

(56) References Cited

U.S. PATENT DOCUMENTS

| | | | | |
|---|---|---|---|---|
| 6,290,777 | B1 | 9/2001 | Imaoka et al. | |
| 2001/0006072 | A1* | 7/2001 | Kobayashi | B08B 3/123 134/64 R |
| 2003/0186624 | A1* | 10/2003 | Koike | B24B 37/30 451/8 |
| 2003/0188770 | A1 | 10/2003 | Doi | |
| 2004/0137828 | A1* | 7/2004 | Takahashi | C03C 15/02 430/4 |
| 2007/0054467 | A1* | 3/2007 | Currie | H01L 21/76254 438/458 |
| 2007/0054497 | A1* | 3/2007 | Weiss | G03F 7/70916 438/758 |
| 2007/0197029 | A1* | 8/2007 | Halimaoui | H01L 21/02068 438/658 |
| 2007/0272280 | A1* | 11/2007 | Liu | H01L 21/67051 134/34 |
| 2009/0165829 | A1* | 7/2009 | Morita | B01D 19/0036 134/105 |
| 2010/0173472 | A1* | 7/2010 | Nagano | H01L 21/76254 438/458 |
| 2012/0012134 | A1* | 1/2012 | Tsukamoto | G03F 7/423 134/1.3 |
| 2012/0325927 | A1* | 12/2012 | Tokoshima | H01L 21/0206 239/8 |

FOREIGN PATENT DOCUMENTS

| | | | |
|---|---|---|---|
| JP | 7-254581 | A | 10/1995 |
| JP | 10-64867 | | 3/1998 |
| JP | 11029794 | A * | 2/1999 |
| JP | 2000-354729 | | 12/2000 |
| JP | 2000354729 | A * | 12/2000 |
| JP | 2003-303798 | A | 10/2003 |
| JP | 2015-79888 | A | 4/2015 |
| KR | 2000-068218 | | 11/2000 |

OTHER PUBLICATIONS

Office Action dated Jan. 10, 2017 in Japanese Patent Application No. 2015-142747 (with unedited computer generated English Translation).

* cited by examiner

WASHING HYDROGEN WATER PRODUCING METHOD AND PRODUCING APPARATUS

CROSS REFERENCE TO RELATED APPLICATION

This application is based upon and claims the benefit of priority from Japanese Patent Application No. 2015-142747, filed on Jul. 17, 2015; the entire contents of which are incorporated herein by reference.

FIELD

Embodiments described herein relate generally to washing hydrogen water producing method and producing apparatus.

BACKGROUND

Conventionally, in the manufacturing process of electronic industrial products such as a semiconductor device, a liquid crystal device and the like, wet cleaning has been performed as an important step of removing fine particles adhering onto a substrate surface. A general method of removing the fine particles is the RCA cleaning method using washing water made by mixing ammonia water, hydrogen peroxide solution and pure water at a volume ratio of, for example, 1:1:5. In the RCA washing method, it is also performed to rinse the washed substrate surface, using ultrapure water.

However, in this method, large amounts of the ammonia water and hydrogen peroxide solution are used. So the large amount of waste liquid such as the used ammonia water and hydrogen peroxide solution and the large amount of ultrapure water for the rinse are wasted. This increases the load of waste liquid disposal. Therefore, this method causes a large environment load problem.

Hence, in recent years, in the above-described manufacturing process of electronic industrial products, a cleaning method using, as the washing water, ultrapure water in which hydrogen gas is dissolved (hereinafter called as hydrogen water) is just beginning to be used. From the ultrapure water in which the hydrogen gas is dissolved, impurities such as dissolved ions, fine particles, organic substances and the like have been removed to the limit. Therefore, static electricity sometimes occurs in the ultrapure water due to friction between the washing water and an inner wall of a pipe and nozzle or the like. In this case, current flows when the washing water comes into contact with electronic components such as the silicon wafer which is a body to be washed, and thereby breaks semiconductor elements on the silicon wafer, resulting in lower yield of products. Therefore, ammonia or the like is dissolved in the washing hydrogen water to adjust the specific resistivity of the washing water to a predetermined value, thereby imparting an antistatic ability to the washing water.

In the method of adding ammonia to the hydrogen water and using it for washing the semiconductor substrate, for example, a liquid concentrate of ammonia water is introduced from a liquid concentrate tank in which the liquid concentrate of ammonia water is accommodated, to a diluting tank. Here, the liquid concentrate of ammonia water is diluted with ultrapure water to generate diluted ammonia water. Thereafter, the diluted ammonia water is added to hydrogen water to obtain washing hydrogen water.

However, the present inventors have found that when the washing hydrogen water is supplied to a washing apparatus for the silicon wafer and the washing of the silicon wafer is repeated in a single-wafer mode of washing the silicon wafer one by one while adding the diluted ammonia water to the hydrogen water by this method, debris of a fine particle form is generated on the washed substrate surface after a lapse of a long time from the start of adjustment of the diluted ammonia water.

SUMMARY

The present invention has been made to solve the above-described problem and its object is to provide washing hydrogen water producing method and producing apparatus capable of preventing generation of fine particles derived from ammonia on a surface of a washed article such as a semiconductor substrate.

A washing hydrogen water producing method in an embodiment, includes: a step of storing ammonia water in a first tank; a step of transferring the ammonia water from the first tank to a second tank; a step of diluting the transferred ammonia water with ultrapure water in the second tank; a step of mixing the diluted ammonia water into hydrogen water; and a washing step of washing an inside of the first tank by ultrapure water to remove fine particles derived from ammonia generated in the first tank.

The method of producing washing hydrogen water in an embodiment preferably further includes: a step of measuring the ammonia water in the first tank.

An apparatus of producing washing hydrogen water in an embodiment, includes: a hydrogen water generating unit configured to dissolve hydrogen gas in ultrapure water; a first tank configured to store ammonia water; a second tank connected to a lower part of the first tank via a first pipeline, and configured to dilute the ammonia water supplied from the first tank via the first pipeline with ultrapure water; a third tank connected to a lower part of the second tank via a second pipeline, and configured to store the diluted ammonia water supplied from the second tank via the second pipeline; a mixing unit configured to mix the diluted ammonia water from the third tank into the hydrogen water to generate washing hydrogen water; and a washing unit configured to wash an inside of the first tank by ultrapure water to remove fine particles derived from ammonia generated in the first tank.

The apparatus of producing washing hydrogen water in an embodiment preferably further includes: a level sensor to detect levels of contents in the first tank and the second tank; opening/closing valves interposed in the first pipeline and the second pipeline, respectively; and a control unit configured to control the opening/closing valves based on a detection result of the level sensor to dilute the ammonia water and wash an inside of the first tank, in a predetermined operation period.

In the washing hydrogen water producing apparatus in an embodiment, it is preferable that the first tank, the second tank, the third tank, the washing unit, and the mixing unit are placed in a clean room.

In the washing hydrogen water producing apparatus in an embodiment preferable further includes: a vent pipe connected to an upper part of the first tank and communicating with the clean room; and a filter interposed in the vent pipe, and configured to remove floating fine particles in the clean room.

It is preferable that the washing unit includes: an ultrapure water supply pipe connected to a side wall of the first tank and configured to supply ultrapure water into the first tank; and an overflow drain connected to an upper part of the first tank and configured to discharge the ultrapure water used for the washing in the first tank to an outside thereof.

By the washing hydrogen water producing method or the washing hydrogen water producing apparatus in an embodiment, it is possible to prevent generation of fine particles derived from ammonia on a surface of a washed article such as a semiconductor substrate.

DETAILED DESCRIPTION

Figure 1:
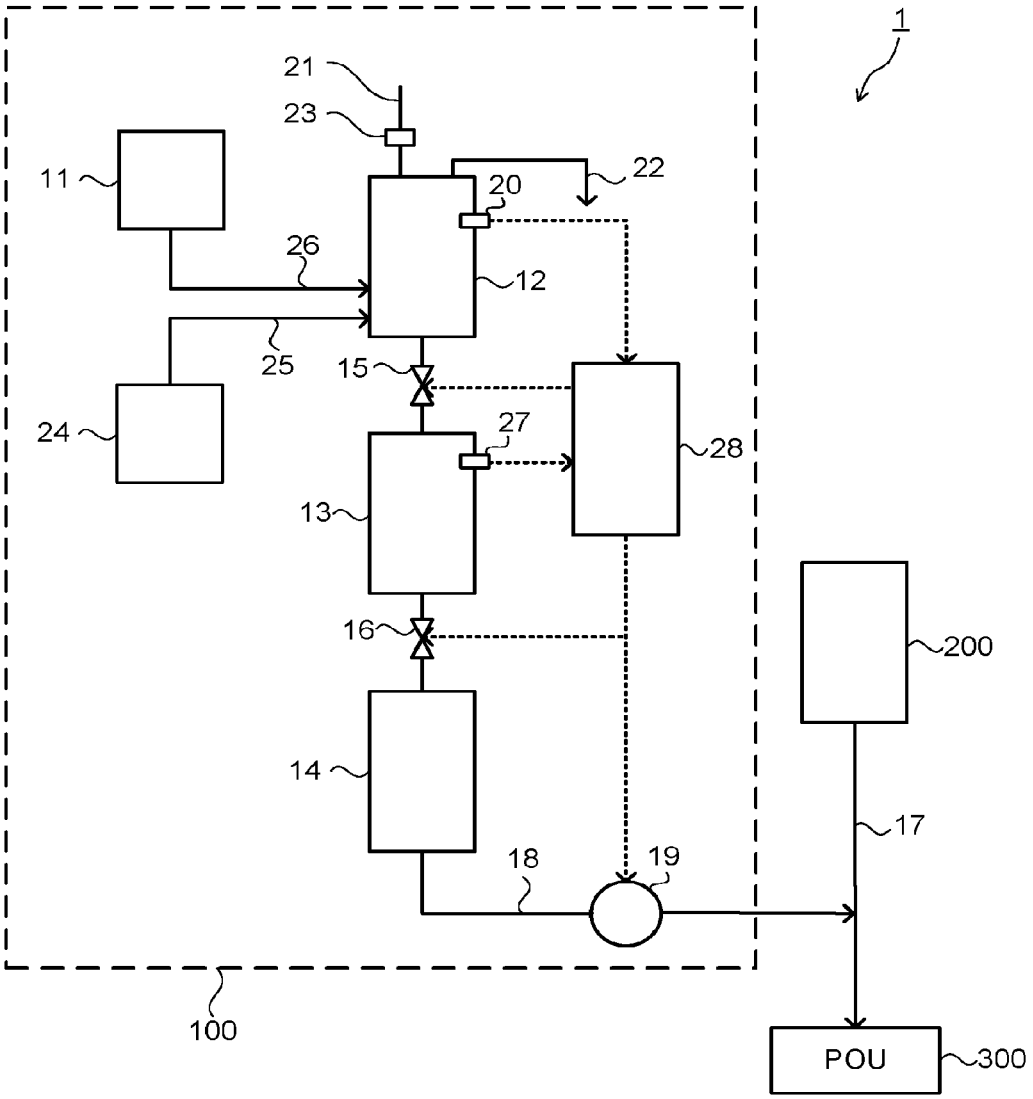
FIG. 1 is a block diagram schematically illustrating an example of a producing apparatus used for a washing hydrogen water producing method of the present invention.

The present inventors further investigated to determine the cause of generation of debris on the substrate surface washed with the diluted ammonia water as describe above. As a result, the present inventors have found that the debris of a fine particle form is derived from ammonia in a tank that stores the liquid concentrate of ammonia water when the liquid concentrate of ammonia water is continuously diluted for a long time in an apparatus that dilutes the liquid concentrate of ammonia water with ultrapure water.

Generally, in a clean room used in the above-described manufacturing plant of electronic industrial products, floating fine particles and the like in the air are removed by a HEPA filter (high-efficiency particulate air filter) made of glass fiber with a pore size of about 0.1 μm or the like, and the air thus cleaned is supplied in the clean room. The diffused air in the clean room is sucked by an air conditioning machine or the like, passed through another filter, and circulated in the clean room. This decreases, as much as possible, the amount of the outside air to be taken into the clean room so as to increase the cleanliness therein.

However, the above-described HEPA filter can remove the floating fine particles in the air but does not remove substances (impurities) passing through the filter, resulting in that a minute amount of impurities float in the clean room. Such impurities are, for example, hydrochloric acid, sulfuric acid, nitric acid, hydrofluoric acid, carbonic acid or the like released in the manufacturing plant of electronic industrial products. Therefore, to take the outside air into the clean room after the impurities mixed therein are removed, a chemical filter, an air washer and the like are also installed in the clean room.

The present inventors have found that in a single-wafer washing step for a silicon wafer, when the liquid concentrate of ammonia water is measured and diluted and the diluted ammonia water is added to hydrogen water to obtain washing water and the silicon wafer is washed with the washing water without washing a measuring tank that accommodates and measures the liquid concentrate of ammonia water, debris in a fine particle form is occasionally generated on the washed silicon wafer surface. It has also been found that the debris in a fine particle form increases with repetition of the single-wafer washing.

The fine particles generated on the silicon wafer surface were found by observing the silicon wafer surface under a scanning electron microscope (SEM). From the above observation, the fine particle has an irregular form with a size of about 0.02 to 0.1 μm or about 0.05 to 0.1 μm and judging from the form, the fine particle is not considered to be generated from a pipe, as cutting dust of the pipe, nor a microorganism. Taking into consideration of the fact that the hydrogen water itself is produced from ultrapure water containing no impurities, the present inventors have investigated a portion where the fine particles are suspected to be mixed in a production process of the washing hydrogen water. As a result, the present inventors have supposed that these fine particles are derived from ammonia remaining in the measuring tank, and they examined and invested to confirm this supposition. More specifically, in the conventional washing method of the silicon wafer, when the above-described debris in a fine particle form was generated, the supply of the hydrogen water to the washing apparatus was stopped once and the inside of the measuring tank was washed with ultrapure water, thereafter washing of the silicon wafer was restarted, and the silicon wafer surface after the washing was observed by SEM. As a result, it has been found that in the case of adding the diluted ammonia water to the hydrogen water and repeatedly supplying it to the washing apparatus while washing the measuring tank by the above method, the increase of the fine particles is not observed any longer.

From the above fact, it is considered that the air in the clean room containing impurities passed through the HEPA filter were taken into the measuring tank, a chemical compound capable of reacting with ammonia in the impurities chemically reacted with ammonia remaining in the measuring tank to generate the fine particles. Then, the fine particles were supplied into the washing hydrogen water through the tank for diluting the ammonia water and the supply tank for storing the diluted ammonia water, and caused a phenomenon of adhering as fine particles onto the silicon wafer washed with the washing hydrogen water.

Hereinafter, an embodiment will be described in detail referring to the drawings. A hydrogen water producing apparatus in this embodiment is a cleaning machine which enable to remove fine particles (ammonium fine particles) generated by the above-described mechanism. FIG. 1 is a diagram schematically illustrating a washing hydrogen water producing apparatus 1 in this embodiment. The washing hydrogen water producing apparatus 1 produces washing hydrogen water to be used for washing a semiconductor substrate and the like in a manufacturing process for electronic industrial products such as the semiconductor device, the liquid crystal device and the like. The washing hydrogen water producing apparatus 1 produces washing hydrogen water in which ammonia water is added to hydrogen water.

The washing hydrogen water producing apparatus 1 includes an ammonia water adding unit 100 that generates diluted ammonia water, and a hydrogen water generating unit 200 that generates the hydrogen water by dissolving hydrogen gas in ultrapure water. The hydrogen water generating unit 200 is connected to a point of use (POU) 300 via a hydrogen water supply pipe 17. The hydrogen water generated in the hydrogen water generating unit 200 is supplied to the point of use 300 through the hydrogen water supply pipe 17. The ammonia water adding unit 100 is connected to a route of the hydrogen water supply pipe 17 to add the diluted ammonia water to the hydrogen water flowing through the hydrogen water supply pipe 17. The point of use 300 is a point to which the washing hydrogen water is supplied and used, and is, for example, a washing apparatus for a semiconductor substrate or the like.

The ammonia water adding unit 100 dilutes a liquid concentrate of ammonia water (thick ammonia water) to generate the diluted ammonia water. The ammonia water adding unit 100 mixes, in a mixing unit, the generated diluted ammonia water into the hydrogen water flowing through the hydrogen water supply pipe 17, and allows hydrogen water with a predetermined ammonia concentration to be supplied to the point of use 300.

The ammonia water adding unit 100 includes a liquid concentrate reservoir 11 that stores the liquid concentrate of ammonia water, and a measuring tank 12 (first tank) that accommodates and measures the liquid concentrate in the liquid concentrate reservoir 11. Further, to a lower part of the measuring tank 12, a diluting tank (second tank) 13 is connected which accommodates and dilutes the liquid concentrate of ammonia water measured in the measuring tank 12. To a lower part of the diluting tank 13, a supply tank (third tank) 14 is connected which stores the diluted ammonia water.

An ultrapure water reservoir 24 is connected to a lower part of the side wall of the measuring tank 12 via an ultrapure water supply pipe 25. The ultrapure water reservoir 24 stores the ultrapure water. The liquid concentrate reservoir 11 is connected to a lower part of the side wall of the measuring tank 12 via a liquid concentrate supply pipe 26. In the liquid concentrate reservoir 11, the thick ammonia water being the liquid concentrate of ammonia water is accommodated.

The measuring tank 12 and the diluting tank 13 are connected by a pipe (first pipeline) having a valve 15 interposed therein, and the diluting tank 13 and the supply tank 14 are connected by a pipe (second pipeline) having a valve 16 interposed therein. The liquid concentrate measured in the measuring tank 12 is introduced into the diluting tank 13 and the supply tank 14 in this order by a drop when the valves 15, 16 are opened. As the valves 15, 16, for example, air-driven opening/closing valves or the like are used.

An ammonia water supply pipe 18 is connected to a bottom of the supply tank 14. In the ammonia water supply pipe 18, a chemical feeding pump 19 is interposed which supplies a predetermined amount of the diluted ammonia water into the hydrogen water supply pipe 17. As the chemical feeding pump 19, a pump which can control the number of strokes is used.

The measuring tank 12 measures and stores a predetermined amount of the liquid concentrate of ammonia water supplied from the liquid concentrate reservoir 11. A level sensor 20 is provided at a side wall of the measuring tank 12. The level sensor 20 senses the water level of the liquid concentrate of ammonia water in the measuring tank 12 and thereby senses the liquid amount, and outputs a detection signal. An upper part of the measuring tank 12 is sealed, and to the upper part of the measuring tank 12, a vent pipe 21 that discharges air in the measuring tank 12 and an overflow drain 22 are connected. In the vent pipe 21, an air filter 23 is interposed. The air filter 23 is not particularly limited as long as it can trap floating fine particles in the air and, for example, a filter made of glass fiber, polypropylene, polyethylene or the like and having a pore size of 0.01 to 0.1 μm is used.

The diluting tank 13 mixes the liquid concentrate of ammonia water and the ultrapure water which are sequentially fed thereinto. Thus, the liquid concentrate of ammonia water is diluted, whereby the diluted ammonia water with the predetermined concentration is prepared. At a side part of the diluting tank 13, a level sensor 27 is provided. The level sensor 27 senses the liquid amount in the diluting tank 13, and outputs a detection signal. The level sensors 20, 27, are, for example, floating type level sensors or ultrasonic wave type level sensors. Further, it is preferable that an upper part of the diluting tank 13 is sealed and is provided with a vent pipe and an air filter (not illustrated) similarly to the measuring tank 12.

The supply tank 14 accommodates and temporarily stores the diluted ammonia water prepared in the diluting tank 13. The diluted ammonia water stored in the supply tank 14 is introduced by the chemical feeding pump 19 into the hydrogen water supply pipe 17 and mixed into the hydrogen water.

The ammonia water adding unit 100 includes a control apparatus 28. The control apparatus 28 controls not-illustrated pumps or valves interposed in the liquid concentrate supply pipe 26 and the ultrapure water supply pipe 25 and opening/closing of the valves 15, 16, on the basis of the detection signals of the level sensors 20, 27. This controls supply or stop of the liquid concentrate of ammonia water or the ultrapure water to the measuring tank 12 or the diluting tank 13. Further, the control apparatus 28 controls the discharge amount (the number of strokes or the like) of the chemical feeding pump 19 so as to supply the diluted ammonia water in the supply tank 14 to the hydrogen water supply pipe 17 in an amount of generating the washing hydrogen water with a predetermined concentration.

The hydrogen water generating unit 200 produces the hydrogen water by dissolving or mixing the hydrogen gas into the ultrapure water. The generated hydrogen water flows through the hydrogen water supply pipe 17, and, in the process, the diluted ammonia water is added thereto by the chemical feeding pump 19 of the ammonia water adding unit 100. Thus, the diluted ammonia water is mixed into the hydrogen water in the hydrogen water supply pipe 17, whereby the washing hydrogen water is produced. The produced washing hydrogen water is then supplied to the point of use 300 via the hydrogen water supply pipe 17.

The hydrogen gas is to be dissolved only needs to be the one produced by a generally-known method. The ultrapure water is produced from for example, tap water, well water, river water, industrial water or the like as raw water and treating the raw water by an ultrapure water producing apparatus, and thereby produced with ionic substances and nonionic substances in the raw water removed therefrom. The resistivity of the ultrapure water is preferably 10 MΩ·cm or more and more preferably 18 MΩ·cm.

The method for dissolving the hydrogen gas into the ultrapure water is for example, a method for dissolving by injecting the hydrogen gas into the ultrapure water via a gas permeable membrane. There also is a method for dissolving the hydrogen gas into the ultrapure water by directly bubbling the hydrogen gas into the ultrapure water that flowing through the pipe. Other examples include a method for dissolving the hydrogen gas by a dispersion means such as a static mixer after injecting the hydrogen gas into the ultrapure water, and a method for dissolving the hydrogen gas into the ultrapure water by supplying the ultrapure water by a pump into a gas dissolver, supplying the hydrogen gas into the ultrapure water on the upstream side from the pump, and agitating them in the pump.

The hydrogen water thus generated in the hydrogen water generating unit 200 preferably has a dissolved hydrogen concentration at 25° C. under 1 atm of 0.1 ppm or more, more preferably 0.5 to 1.6 ppm, and furthermore preferably 1.0 to 1.2 ppm.

Figure 2:
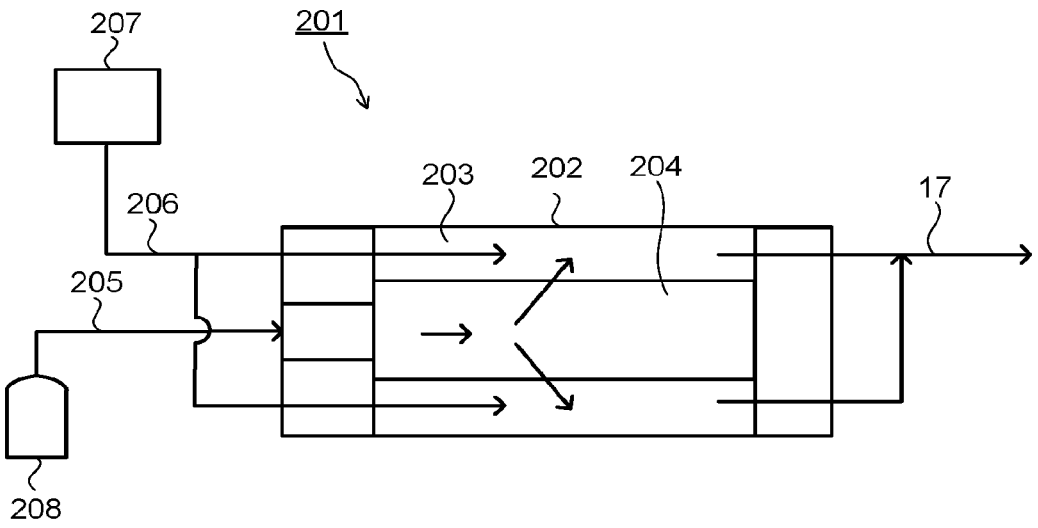
FIG. 2 is a schematic diagram illustrating an example of a hydrogen water generating unit used for the washing hydrogen water producing apparatus of the present invention.

FIG. 2 schematically illustrates, as one example of the hydrogen water generating unit 200, a hydrogen water generating unit 201 that injects and dissolves the hydrogen gas into the ultrapure water via the gas permeable membrane. The hydrogen water generating unit 201 is an apparatus that uses a hollow fiber membrane as the gas permeable membrane and dissolves the hydrogen gas into the ultrapure water via the hollow fiber membrane. The hydrogen water generating unit 201 illustrated in FIG. 2 includes a hollow fiber membrane dissolver 202 (hollow fiber membrane unit) in which the hollow fiber membrane is installed. To the inside of the hollow fiber membrane dissolver 202, a water-to-be-treated supply pipe 206 is connected which supplies the ultrapure water from an ultrapure water supply apparatus 207 to the hollow fiber membrane dissolver 202. The ultrapure water is supplied to an outside 203 of the hollow fiber membrane through the water-to-be-treated supply pipe 206. Meanwhile, the hydrogen gas is supplied from a hydrogen gas supply apparatus 208 to an inside 204 of the hollow fiber membrane through a gas supply pipe 205 connected to the hollow fiber membrane dissolver 202. Thus, the hydrogen on the inside 204 permeates the hollow fiber membrane and diffuses to the outside 203 (ultrapure water side), whereby the hydrogen gas is dissolved in the ultrapure water, resulting in generation of the hydrogen water. To a water outflow port of the hollow fiber membrane dissolver 202, the hydrogen water supply pipe 17 is connected, and the generated hydrogen water is discharged to the outside of the hollow fiber membrane dissolver 202 via the hydrogen water supply pipe 17.

Further, to enhance the solubility of the hydrogen gas in the hydrogen water generating unit 200, it is preferable to remove in advance dissolved gas such as dissolved oxygen, dissolved nitrogen or the like in the ultrapure water supplied to the hydrogen water generating unit 200. Thus, for example, the dissolved hydrogen concentration in the ultrapure water supplied to the hydrogen water generating unit 200 is preferably reduced to about 0.1 ppm or less. Therefore, it is preferable to provide a degassing apparatus at the previous stage to the hydrogen water generating unit 200. As the degassing apparatus, a vacuum degassing apparatus equipped with a gas permeable membrane or the like is preferably used.

Figure 3:
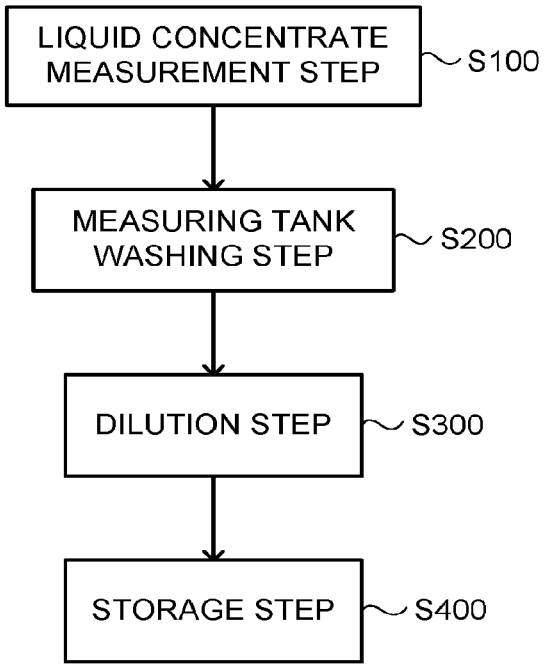
FIG. 3 is a flowchart schematically illustrating an example of the washing hydrogen water producing method of the present invention.

Next, a washing hydrogen water producing method using the washing hydrogen water producing apparatus 1 illustrated in FIG. 1 will be described. FIG. 3 is a block diagram schematically illustrating the washing hydrogen water producing method in this embodiment. The washing hydrogen water producing method illustrated in FIG. 3 includes a step of a liquid concentrate measurement step S100 of accommodating and measuring the liquid concentrate of ammonia water in the measuring tank 12 in FIG. 1, a measuring tank washing step S200 of washing the measuring tank 12, a dilution step S300 of measuring the ultrapure water and mixing the measured ultrapure water and the liquid concentrate of ammonia water measured at the liquid concentrate measurement step S100 to generate the diluted ammonia water, and a storage step S400 of storing the diluted ammonia water.

First, the control apparatus 28 closes the valves 15, 16. Then, the control apparatus 28 introduces the liquid concentrate of ammonia water from the liquid concentrate reservoir 11 into the measuring tank 12 via the liquid concentrate supply pipe 26 (S100). The concentration of the liquid concentrate of ammonia water is not particularly limited, but is normally about 5 to 35 mass %. The control apparatus 28 introduces the liquid concentrate of ammonia water into the measuring tank 12 via the liquid concentrate supply pipe 26 in a manner to prevent its liquid surface from becoming rough at a flow rate of, for example, 20 to 50 mL/min. In this event, the level sensor 20 senses the water level of the liquid concentrate of ammonia water in the measuring tank 12 and, when the liquid concentrate in the measuring tank 12 reaches a predetermined water level, inputs a detection signal of stopping the supply of the liquid concentrate of ammonia water, into the control apparatus 28. Thus, the control apparatus 28 stops the not-illustrated pump interposed in the liquid concentrate supply pipe 26, and thereby stops the supply of the liquid concentrate of ammonia water from the liquid concentrate reservoir 11 into the measuring tank 12. As a result, a predetermined amount in a range of 50 to 150 mL of the liquid concentrate of ammonia water is measured in the measuring tank 12. Meanwhile, the liquid concentrate reservoir 11 may be disposed above the upper part of the measuring tank 12 and the valve may be interposed instead of the above pump in the liquid concentrate supply pipe 26. In this case, the liquid concentrate of ammonia water is gravitationally introduced from the liquid concentrate reservoir 11 into the measuring tank 12 when the control apparatus 28 opens the above valve in the liquid concentrate supply pipe 26. When the control apparatus 28 closes the above valve in the liquid concentrate supply pipe 26, the supply of the liquid concentrate of ammonia water from the liquid concentrate reservoir 11 to the measuring tank 12 is stopped. Thereafter, with the valve 16 closed, the control apparatus 28 opens the valve 15. Thus, the liquid concentrate measured in the measuring tank 12 is introduced from the measuring tank 12 into the diluting tank 13 by a drop.

Next, the control apparatus 28 closes the valve 15 of the ammonia water adding unit 100 illustrated in FIG. 1. Then, the control apparatus 28 operates the not-illustrated pump interposed in the ultrapure water supply pipe 25 to introduce the ultrapure water in the ultrapure water reservoir 24 into the measuring tank 12. In this event, the control apparatus 28 introduces the ultrapure water at a flow rate of, for example, 200 to 1000 mL/min until the measuring tank 12 is filled with the ultrapure water and further the ultrapure water overflows. The overflowed ultrapure water is drained from the overflow drain 22 to the outside of the measuring tank 12 (S200). In this process, the inside of the measuring tank 12 is washed with the introduced ultrapure water.

The control apparatus 28 performs the measuring tank washing step S200, for example, for 1 to 10 minutes and preferably 1 to 5 minutes though depending on the interior content of the measuring tank 12. This makes it possible to remove the liquid concentrate of ammonia water remaining in the measuring tank 12 after the liquid concentrate measurement step S100 and discharge the liquid concentrate of ammonia water to the outside of the measuring tank 12.

Then, the control apparatus 28 opens the valve 15, with the valve 16 kept closed, to introduce the ultrapure water into the measuring tank 12 via the ultrapure water supply pipe 25 in a manner to prevent its liquid surface from becoming rough. The ultrapure water introduced into the measuring tank 12 is introduced under its own weight into the diluting tank 13 via the measuring tank 12. Thus, the liquid concentrate of ammonia water in the diluting tank 13 is diluted with the ultrapure water (S300). In this event, the level sensor 27 senses the water level in the diluting tank 13. When the water level in the diluting tank 13 reaches a predetermined water level, the level sensor 27 inputs a detection signal of stopping the supply of the ultrapure water, into the control apparatus 28. Thus, the control apparatus 28 stops the not-illustrated pump interposed in the ultrapure water supply pipe 25, and thereby stops the supply of the ultrapure water into the diluting tank 13. Meanwhile, the ultrapure water reservoir 24 may be disposed above the upper part of the measuring tank 12 and the valve may be interposed instead of the above pump in the ultrapure water supply pipe 25. In this case, the liquid concentrate of ammonia water is gravitationally introduced from the ultrapure water reservoir 24 into the diluting tank 13 when the control apparatus 28 opens the above valve interposed the ultrapure water supply pipe 25. When the control apparatus 28 closes the above valve interposed the ultrapure water supply pipe 25, the supply of the liquid concentrate of ammonia water from the ultrapure water reservoir 24 into the diluting tank 13 is stopped. As a result, the ultrapure water is measured in the diluting tank 13. The amount of the ultrapure water measured at the dilution step S300 can be arbitrarily set according to the amount of the liquid concentrate of ammonia water measured at the liquid concentrate measurement step S100 and the concentration of the diluted ammonia water to be added to the hydrogen water. The amount of the ultrapure water measured at the dilution step S300 is an amount for diluting the liquid concentrate of ammonia water measured at the liquid concentrate measurement step S100, to 20 to 40 times and more preferably to about 30 times. More specifically, for example, in the case of measuring 50 mL of the liquid concentrate of ammonia water at the liquid concentrate measurement step S100 and diluting to 10 times, 450 mL of the ultrapure water only needs to be measured at the dilution step S300.

After performing the dilution step S300, the control apparatus 28 opens the valve 16. Thus, the diluted ammonia water is introduced, by a drop, from the diluting tank 13 into the supply tank 14, and stored therein (S400).

By appropriately repeating the above-described liquid concentrate measurement step S100 to storage step S400, a predetermined amount of the diluted ammonia water is stored in the supply tank 14. Further, the above-described liquid concentrate measurement step S100 to storage step S400 are performed for each predetermined operation period, whereby the diluted ammonia water is prepared and stored in the supply tank 14 while the fine particles derived from ammonia generated in the measuring tank 12 are being washed away by the ultrapure water.

The diluted ammonia water stored in the supply tank 14 is mixed into the hydrogen water flowing through the hydrogen water supply pipe 17 via the ammonia water supply pipe 18 by the chemical feeding pump 19 in an amount so that the ammonia concentration in the washing hydrogen water becomes a predetermined concentration. Thus, the washing hydrogen water is prepared.

The concentration of ammonia in the washing hydrogen water is measured, for example, using conductivity as an index. For example, the concentration of ammonia in the washing hydrogen water is adjusted so that the conductivity becomes 40 μS/cm (corresponding to an ammonia concentration of 20 ppm). The concentration of ammonia in the washing hydrogen water can be measured by a conductivity meter. For example, the conductivity meter measures the conductivity of the washing hydrogen water. Based on the measured value, the control apparatus 28 outputs a concentration control signal to the chemical feeding pump 19 so that the concentration of ammonia in the washing hydrogen water becomes the above-described concentration, and controls, for example, the number of strokes of the chemical feeding pump 19. The number of strokes is controlled, for example, to fall within a range of 0 to 360 times and more preferably a range of 150 to 240 times per minute. Further, the supply amount of the diluted ammonia water per stroke is preferably 65 to 130 mL.

The washing hydrogen water producing apparatus 1 is installed such that at least the ammonia water adding unit 100 is disposed in a clean room used in a manufacturing plant of the above-described electronic industrial products.

By the washing hydrogen water producing method and producing apparatus in the above-described embodiments, at the measuring tank washing step S200, the thick ammonia water remaining in the measuring tank 12 is washed away and removed, so that the generation of fine particles derived from ammonia is suppressed. As a result, it is possible to avoid supply of the fine particles into the hydrogen water so as to prevent adhesion of the fine particles onto a silicon wafer which is washed with the hydrogen water.

Note that by the washing hydrogen water producing method and producing apparatus in this embodiments, it is possible to prevent adhesion of the fine particles onto the silicon wafer only by changing the piping route such as a connection part of, for example, the ultrapure water supply pipe of a chemical diluting means which is conventionally used. Therefore, as compared to the method of installing the above-described chemical filter, air washer and the like to prevent mixture of impurities into the clean room to thereby prevent generation of fine particles derived from ammonia, the washing hydrogen water producing method and producing apparatus can prevent adhesion of the fine particles onto the silicon wafer by simple apparatus and simple operation and are thus economically advantageous.

Besides, what kind of impurities entering the clean room generate the fine particles derived from ammonia is a problem to be investigated, and part of the mechanism of generating the fine particles derived from ammonia is still unclear. Therefore, there is a concern about whether or not the installation itself of the above-described chemical filter and the like is effective in preventing generation of the fine particles derived from ammonia, and there is nothing for it but to actually install the chemical filter and the like for verification. Considering this point, the method of the present invention can surely prevent generation of the fine particles derived from ammonia, and is thus industrially and economically advantageous.

EXAMPLE

Example 1

Next, examples will be described. Washing hydrogen water was produced using the same apparatus as that illustrated in FIG. 1. The produced washing hydrogen water was supplied to a single-wafer washing apparatus to wash a silicon wafer.

First, in the ammonia water adding unit 100, with the valves 15, 16 closed, the liquid concentrate of ammonia water (a concentration of about 29 mass %) was fed into the measuring tank 12 from the liquid concentrate supply pipe 26 connected to the lower part of the measuring tank 12 at a flow rate of 20 to 50 mL/min in a manner to prevent its liquid surface from becoming rough, and 50 mL thereof was measured. After the liquid concentrate of ammonia water was measured, the valve 15 at the lower part of the measuring tank 12 was opened to feed the liquid concentrate of ammonia water to the diluting tank 13 connected to the lower part of the measuring tank 12 via the pipe.

Next, the valve 15 at the lower part of the measuring tank 12 was closed to introduce the ultrapure water into the measuring tank 12 from the ultrapure water supply pipe 25 connected to the lower part of the measuring tank 12 at a flow rate of 1000 mL/min. The ultrapure water was continued to be fed also after the measuring tank 12 was filled therewith to overflow, and drained from the overflow drain 22 at the upper part of the measuring tank 12. This process was performed for about 10 minutes. Thus, the liquid concentrate of ammonia water remaining in the measuring tank 12 was washed away and discharged.

Thereafter, with the valve 16 kept closed, the valve 15 at the lower part of the measuring tank 12 was opened to supply the ultrapure water into the diluting tank 13 via the measuring tank 12. At this time, the ultrapure water does not remain in the measuring tank 12 but immediately flows down into the diluting tank 13 because the flow rate of the ultrapure water from the ultrapure water supply pipe 25 to the measuring tank 12 is much smaller than the flow rate of the ultrapure water flowing through the valve 15.

When the liquid amount measured by the level sensor in the diluting tank 13 reached 1500 mL, the pump interposed in the ultrapure water supply pipe 25 was stopped with the valve 15 kept open, and 1450 mL of the ultrapure water was measured. In this manner, the liquid concentrate of ammonia water was diluted to 30 times in the diluting tank 13, whereby diluted ammonia water having a concentration of about 1 mass % was prepared. The prepared diluted ammonia water was introduced into the supply tank 14 by opening the valve 16, and temporarily stored in the supply tank 14. Thereafter, the diluted ammonia water in the supply tank 14 was added into the hydrogen water (a hydrogen concentration of 1.2 ppm) flowing through the hydrogen water supply pipe 17 by the chemical feeding pump 19. The hydrogen water was produced using, as the hydrogen water generating unit 200, the same hollow fiber membrane dissolving type hydrogen water producing apparatus as in FIG. 2.

When the diluted ammonia water in the supply tank 14 reached 500 mL or less, measurement of the liquid concentrate of ammonia water was started again in the measuring tank 12, and the diluting operation of the liquid concentrate of ammonia water was performed similarly to the above. A period from the initial measurement of the liquid concentrate of ammonia water in the measuring tank 12 to the next measurement of the liquid concentrate of ammonia water in the measuring tank 12 was about 1 hour. While the operations of measurement, dilution, and addition to the hydrogen water of the liquid concentrate of ammonia water, and the washing of the measuring tank 12 were continuously repeated in the above manner, the produced washing hydrogen water was supplied to the single-wafer washing apparatus to wash the silicon wafer.

After a lapse of a predetermined period from the start of supply (washing initial stage) of the diluted ammonia water to the hydrogen water, the surface of the washed silicon wafer was observed under SEM, and the number of fine particles on the silicon wafer surface was measured. The number of fine particles measured is listed in Table 1 as a relative value regarding the number of fine particles on the silicon wafer surface immediately after the start of washing (washing initial stage) as 1. In Example, even when the single-wafer washing was repeated, there was no increase from the washing initial stage in the number of fine particles on the washed silicon wafer surface.

Comparative Example

In the apparatus used in Example, the ultrapure water supply pipe 25 was connected to the lower part of the diluting tank 13, instead of the measuring tank 12, and supplied the ultrapure water for dilution into the diluting tank 13. The same operations as those of Example except that the washing of the measuring tank 12 was not performed, were performed to produce washing hydrogen water, which was used to wash a silicon wafer. Then, the number of fine particles on the washed silicon wafer surface was measured. The number of fine particles measured is listed in Table 1 as a relative value regarding the number of fine particles on the silicon wafer surface immediately after the start of washing as 1.

In Comparative Example, after about 2 months after the start of supply (washing initial stage) of the diluted ammonia water to the hydrogen water, there was an increasing tendency in the number of fine particles on the washed silicon wafer surface, and after about 5 months, fine particles of 20 times as many as those at the start of supply of the diluted ammonia water to the hydrogen water were measured.

Example 2

When washing of the measuring tank 12 was performed as in Example 1 after about 4 months in Comparative Example, the number of fine particles generated on the silicon wafer surface decreased to the number equal to that at the washing initial stage. From this fact, the fine particles on the silicon wafer surface are considered to be derived from the liquid concentrate of ammonia water remaining in the measuring tank 12.

TABLE 1

| | ELAPSED PERIOD (MONTH) | WASHING INITIAL STAGE (0) | 1 | 2 | 3 | 4 | 5 |
|---|---|---|---|---|---|---|---|
| NUMBER OF FINE PARTICLES (RELATIVE VALUE) | EXAMPLE 1 | 1 | 1 | 1 | 1 | 1 | 1 |
| | EXAMPLE 2 | 1 | 1 | 3 | 6 | 15 | 1 |
| | COMPARATIVE EXAMPLE | 1 | 1 | 3 | 6 | 15 | 20 |

As illustrated in the above Examples, by the washing hydrogen water producing method and producing apparatus in the embodiments, it is possible to decrease the number of fine particles on a surface of a washed article (semiconductor substrate or the like) washed with hydrogen water in which ammonia is dissolved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method of producing washing hydrogen water, the method comprising:

introducing ammonia water into a first tank to measure an amount of the ammonia water;

transferring the ammonia water from the first tank to a second tank;

diluting the transferred ammonia water with ultrapure water in the second tank;

mixing the diluted ammonia water into hydrogen water; and washing an inside of the first tank with additional ultrapure water to remove fine particles derived from ammonia generated in the first tank.

2. The method of claim 1, further comprising:

measuring the ammonia water in the first tank.

3. The method of claim 1, wherein the first tank is filled with the additional ultrapure water during the washing causing the first tank to overflow.

4. The method of claim 1, wherein the washing removes fine particles generated in the introducing and the transferring.

5. The method of claim 1, wherein the ultrapure water and the additional ultrapure water have a resistivity of at least 18 MΩ·cm.

6. The method of claim 1, wherein the hydrogen water has a dissolved hydrogen concentration at 25° C. under 1 atm of at least 0.1 ppm.

* * * * *